US005385286A

United States Patent [19]

Johnson, Jr.

[11] Patent Number: 5,385,286

[45] Date of Patent: Jan. 31, 1995

[54] ADJUSTABLE DEPTH CONTROL FOR USE WITH A FASTENER DRIVING TOOL

[75] Inventor: Paul L. Johnson, Jr., Fayetteville, Ohio

[73] Assignee: Senco Products, Inc., Cincinnati, Ohio

[21] Appl. No.: 178,539

[22] Filed: Jan. 7, 1994

[51] Int. Cl.[6] ..... B25C 1/04

[52] U.S. Cl. ..... 227/8; 227/142

[58] Field of Search ..... 227/8, 142

[56] References Cited

U.S. PATENT DOCUMENTS

| | | | |
|---|---|---|---|
| 3,204,400 | 9/1965 | Kvavle | 227/8 |
| 3,519,186 | 7/1970 | Volkmann | 227/8 |
| 4,767,043 | 8/1988 | Canlas, Jr. | 227/8 |
| 4,821,937 | 4/1989 | Rafferty | 227/142 |
| 5,219,110 | 6/1993 | Mukoyama | 227/8 |

FOREIGN PATENT DOCUMENTS

| | | | |
|---|---|---|---|
| 398308 | 9/1933 | United Kingdom | 227/142 |

*Primary Examiner*—Scott A. Smith

*Attorney, Agent, or Firm*—Jerrold J. Litzinger

[57] ABSTRACT

An adjustable depth control for use with a fastener driving tool having an upper arm, a coupling, and a lower arm. The upper arm is rigidly attached within the coupling, while the lower arm is threaded into the other end of the coupling. The bottom of the coupling contains a cam surface which is biased by a spring against a mating cam surface on a retainer which holds the lower arm within the guide body, and prevents the coupling from rotating. The coupling is moved out of contact with the retainer and rotated to change the position of the lower arm with respect to the nose piece of the tool.

8 Claims, 4 Drawing Sheets

ADJUSTABLE DEPTH CONTROL FOR USE WITH A FASTENER DRIVING TOOL

BACKGROUND OF THE INVENTION

This invention relates generally to a depth of drive control for use with a fastener driving tool, and in particular, to a novel device which can be easily adjusted by the operator to control the depth of penetration of the fastener into a workpiece.

Powered fastener driving tools for driving staples, nails, and the like are very widely used today whenever it is necessary to fasten pieces of wood together. Tools of this type are generally equipped with a safety on the nosepiece which prevents the tool from actuating unless the nosepiece is in contact with a workpiece.

One problem which arises when using tools of the type previously described results from the fact that each fastener is driven from the tool with the same energy each time that the tool is actuated. This will cause fasteners to be driven to an inconsistent depth if there is a significant variation in the density of the material into which the fasteners are to be driven; or if a worker is using a combination of wood types (soft and hard) for a particular application. In addition, sometimes it is desirable to countersink the head of a nail beneath the surface of the workpiece. It is possible to compensate for this by adjusting the air pressure supplying the tool; however, this method is time consuming, and is difficult to accurately determine the proper pressure setting to reach the desired depth of drive for each fastener.

The problem of controlling the depth of drive for fastener driving tools has been addressed in the prior art. U.S. Pat. No. 3,519,186 which issued Jul. 7, 1970, to Dieter Volkmann, teaches a pneumatic fastener driving tool in which a notched plate is moveable longitudinally with respect to the from plate and the drive track of the tool. The from plate and the notched plate are each provided with knurlings or corrugations such that it is possible to adjust the notched plate in any desired position relative to the front plate. However, as the two plates are maintained in position by a series of screws, it is necessary to use tools to adjust the position of the plates when it is desired to vary the depth of drive, which can be time consuming if it is often necessary to vary the depth during a particular application.

This problem was addressed again in U.S. Pat. No. 4,7677,043, which issued to Prudencio S. Canlas, Jr. on Aug. 30, 1988. This patent teaches a manual adjusting mechanism for the work contacting element of a fastener driving tool which includes a manually operable member movable by manual engagement to effect an adjustment of the adjusting mechanism and a releasably lock movable between a locking position for locking the manually operable member against manual movement and a releasing position enabling the manually operable member to be manually moved. This is accomplished in the invention by a door which, when closed, allows a leaf spring to lock the adjusting mechanism in place and when opened, shifts the leaf spring away from the adjusting mechanism to allow for manual rotation. While this device is effective to allow adjustment of depth of drive, it requires that a section of the tool be opened for access to the adjusting mechanism.

Another example of a depth of drive adjustment for a fastener driving tool is taught in U.S. Pat. No. 5,219,110, which issued Jun. 15, 1993, to Kenji Mukoyama. This mechanism for adjusting drive depth includes a cam device interposed between an upper part and a lower part of the workpiece contacting element. The cam device, which consists of an upper cam and a lower cam, is manually rotatable to vary the depth of penetration of fasteners into a workpiece.

While each of the aforementioned prior art devices allows for adjustment of the driving depth for a fastener driving tool, they all suffer from undesirable characteristics, such as the need for additional tools, the necessity to open part of the tool to gain access, or unnecessary complexity of the mechanism to accomplish the desired adjustment.

SUMMARY OF THE INVENTION

It is therefore an object of the present invention to provide a novel mechanism for adjusting the depth of drive of fasteners for a fastener driving tool which is economical and easily operated.

Another object of the present invention is to provide an improved adjustable depth control for use with a fastener driving tool which allows for safe and quick adjustment without the use of additional tools or the necessity of gaining access to the interior of any part of the tool.

It is a further object of the present invention to provide an adjusting mechanism to control depth of drive of fasteners which is reliable yet simple, and is not susceptible to changing position during normal use of the tool.

These and other objects are accomplished in the present instance by a novel workpiece contacting element having an upper safety rod, a lower safety rod, and a coupling which attaches the two rods together. Upper rod is rigidly affixed to the coupling to prohibit linear motion relative to the parts, while lower rod is threadedly coupled to the coupling. The bottom side of the coupling has a cam surface which is spring biased against a spacer through which the lower rod extends, preventing the coupling from rotating. To adjust the travel of the lower rod, the coupling is moved out of locking engagement from the spacer and rotated, shifting the lower rod to a particular position for the desired depth of drive.

DETAILED DESCRIPTION OF THE INVENTION

Figure 1:
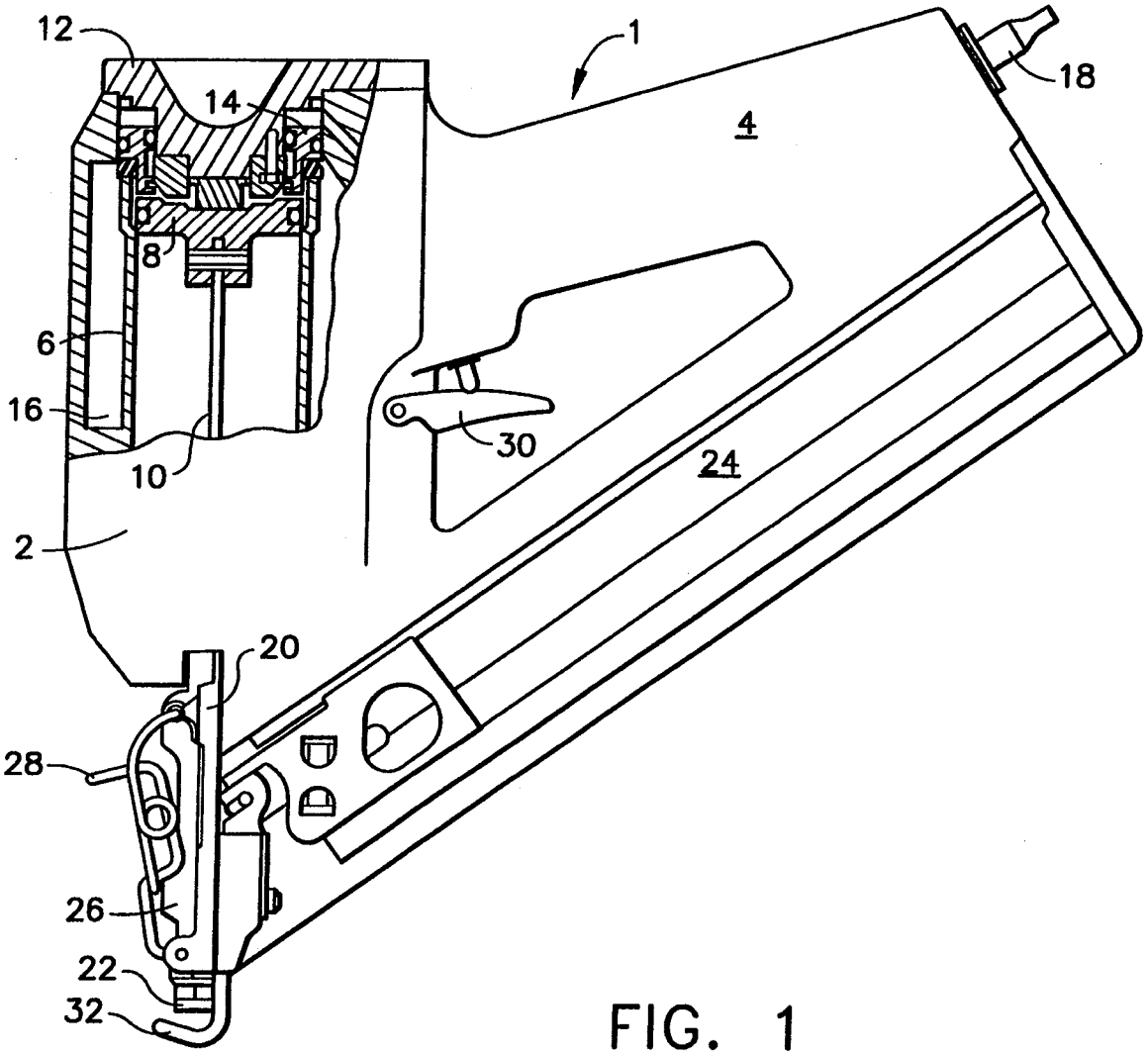
FIG. 1 is a side elevational view, partly in cross section, of an exemplary pneumatic fastener driving tool to which the teachings of the present invention may be applied.

Referring now to FIG. 1, an exemplary pneumatic fastener driving tool of the type on which the present invention may be used is generally indicated at 1. Tool 1 consists of a main body portion 2 and a handle portion 4. Main body portion 2 and handle portion 4 are generally hollow. A working cylinder 6 is located within main body portion 2 and is provided with a piston 8 to which a driver 10 is affixed.

The upper end of main body portion 2 is closed by a cap 12 which supports a firing valve assembly 14. Tool 1 is provided with a reservoir 16 for air under pressure which surrounds cylinder 6 and extends into handle portion 4. Air reservoir 16 is connected to an appropriate source of air under pressure through a line (not shown) connected to a fitting 18 at the rearward end of handle portion 4.

Beneath main body portion 2, tool 1 is provided with a guide body 20 terminating in a nose piece 22. Guide body 12 provides an internal passage or drive track for driver 10 and into which fasteners (not shown) are successively delivered from a magazine 24 which is affixed at its forward end beneath main body portion 2 and at its rearward end beneath handle portion 4. Guide body 12 may be provided with a front gate 26 and latch assembly 28 therefor, by which access may be gained to the drive track.

Tool 1 is generally equipped with a manual trigger 30, which is located beneath handle portion 4, and a workpiece contacting element or safety 32, which passes through guide body 20 and terminates at its upper end beneath handle portion 4 in the vicinity of trigger 30. Safety 32 is normally the type which, when tool nose piece 22 is placed against a workpiece, contacts the workpiece and is urged upwardly, as viewed in FIG. 1. Safety 32, which is spring biased into its normal unactuated position, normally disables manual trigger 30 unless it is shifted into its actuated position when tool nose piece 22 pressed against a workpiece. This type of operation is disclosed in U.S. Pat. No. 3,278,106 entitled "Firing Control Means" which is assigned to the assignee of the present invention, and is incorporated by reference into the present application.

Figure 2:
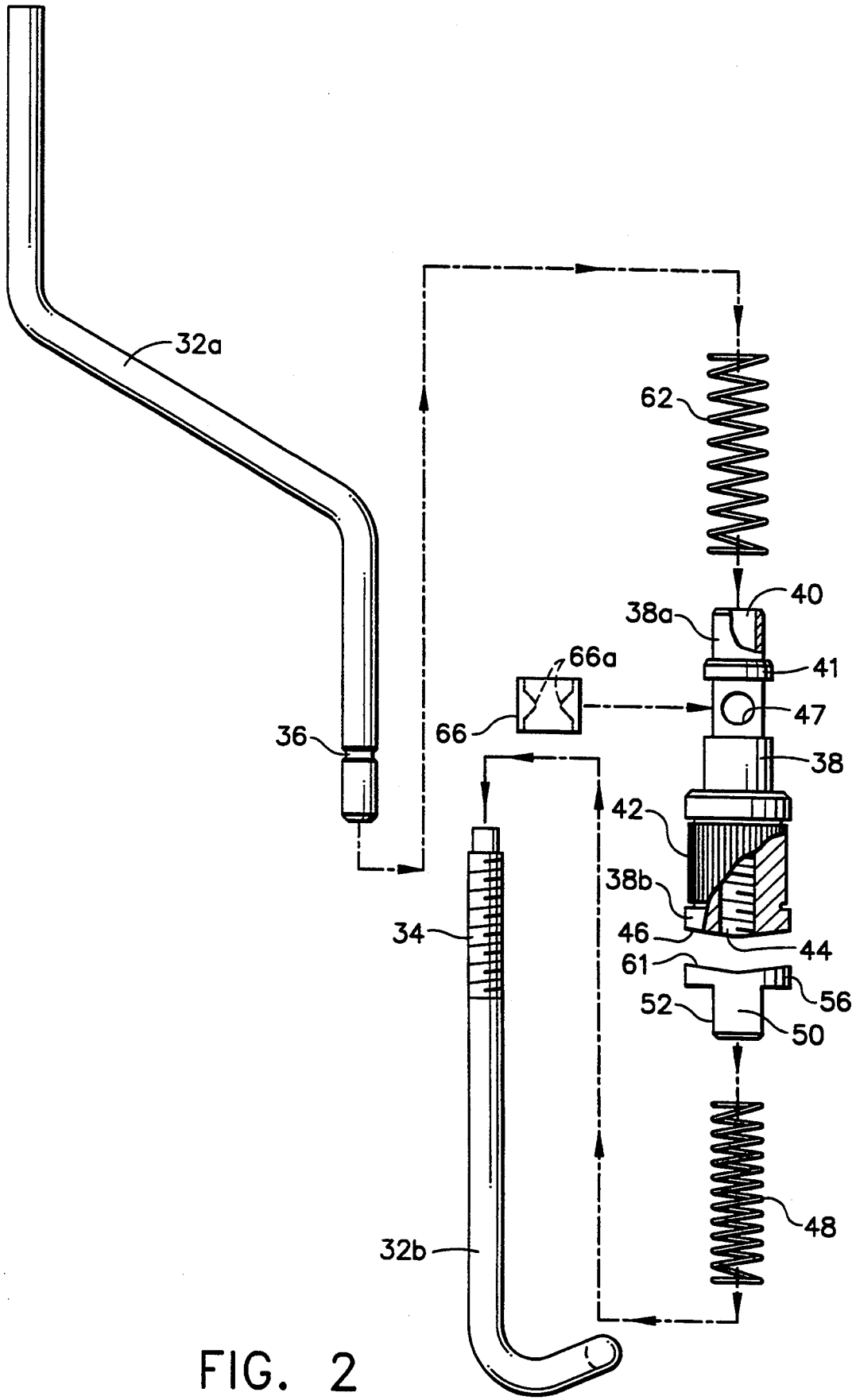
FIG. 2 is an exploded view, partly in cross section, of the components which comprise the adjustable depth control device of the present invention.

Referring now to FIG. 2, the components of the present invention will be described in detail. Safety 32 is comprised of an upper safety rod **32*a* and a lower safety rod 32*b*. The upper portion of lower safety rod 32*b* contains an externally threaded portion 34, while the lower portion of upper safety rod 32*a* contains an annular groove 36. Upper and lower safety rods 32*a* and 32*b* are connected together by use of a coupling 38. Coupling 38 consists of an upper portion 38*a* containing an axial bore 40 and an annular shoulder 41, and a lower portion 38*b* having a knurled outer surface 42 and containing an internally threaded axial bore 44. Lower portion 38*b* terminates in a cam surface 46. Upper portion 38*a* also contains an aperture 47 which passes transversely through coupling 38**.

Figure 3:
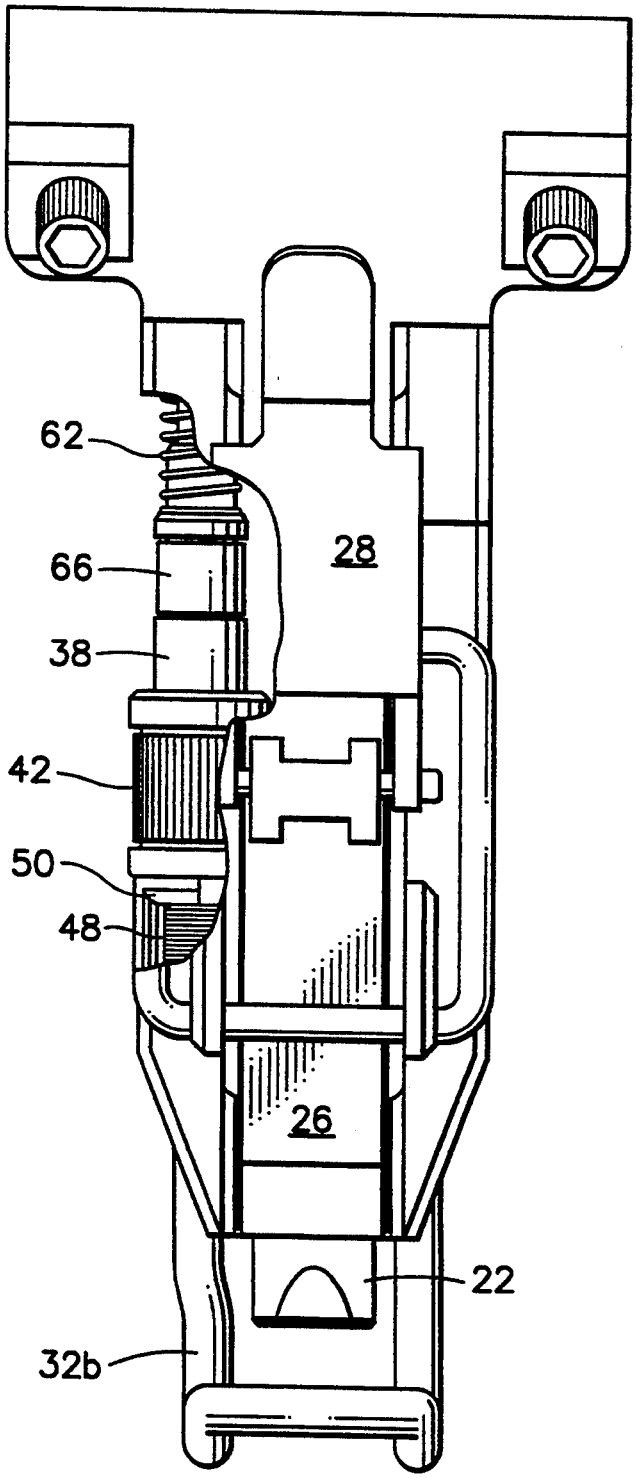
FIG. 3 is a front elevational view of a tool containing the depth control device of the present invention.
Figure 4:
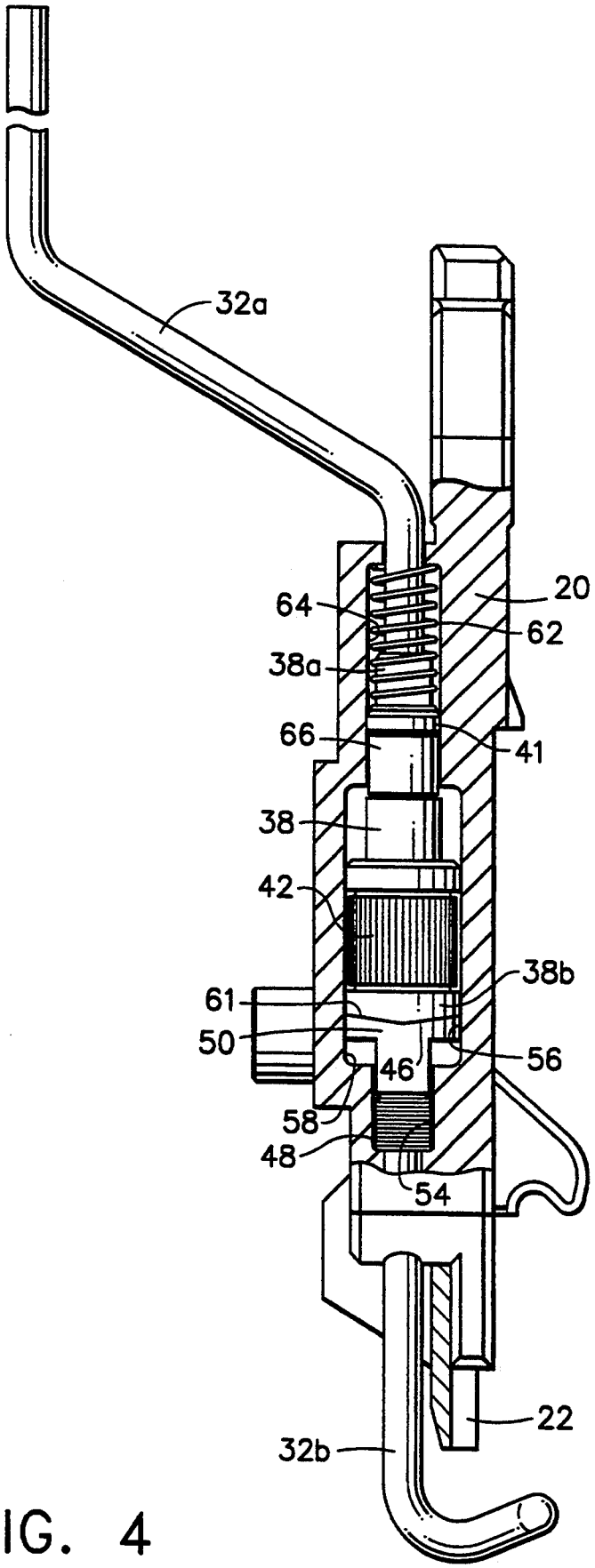
FIG. 4 is a side elevational view of the depth control device of the present invention.

The operation of the present invention is best described while referring to FIGS. 3 and 4. Lower safety rod **32*b* is inserted through the bottom end of guide body 20, and passes through a lower spring 48 and a spacer 50, and coupling 38 is attached to the upper portion of rod 32*b* by virtue of engagement of threaded portion 34 of rod 32*b* within internally threaded bore 44 of coupling 38. Spacer 50 contains a lower section 52 which fits within a lower section 54 within guide body 20, and an upper section 56 which fits within an intermediate section 58 of guide body 20. The upper surface of spacer 50 consists of a cam surface 61 which complements cam surface 46 of coupling 38. Spring 48 is positioned between the bottom of lower section 54 of guide body 20 and spacer 50 such that spacer 50 is biased by spring 48 to remain in contact with coupling 38. Spacer 50 is of a rectangular configuration such that when it is retained within guide body 20**, it cannot rotate.

Upper safety rod **32*a* is inserted through the top end of guide body 20 through an upper spring 62 within an upper section 64 of guide body 20 into axial bore 40 of upper portion 38*a* of coupling 38. Coupling 38 is rigidly affixed to upper safety rod 32*a* by virtue of a retainer 66 which fits around upper portion 38*a*. Retainer 66 contains a pair of lugs 66*a*, shown in phantom in FIG. 2, which extend through aperture 47 of coupling 38 and are held within groove 36 on the lower portion of upper safety rod 32*a*, thus allowing coupling 38 to be rotated about upper safety rod 32*a***.

Spring 62 is positioned between the upper surface of upper section 64 of guide body 20 and shoulder 41 of coupling 38 such that the entire assembly 32 consisting of upper rod **32*a*, coupling 38, and lower rod 32*b* is biased by spring 62 toward the bottom of guide body 20. Spring 48 has a slightly smaller spring force rate than spring 64** so that it will compress easier.

Adjustment of the depth of drive for tool 1 is accomplished in the following manner. When work contacting element or safety 32 is in its unactuated position, as shown in FIGS. 3 and 4, spring 62 biases safety assembly 32 to its lowermost position. Cam surface 46 of coupling 38 and cam surface 61 of spacer 50 are in mating engagement such that coupling 38 cannot rotate, as spring 48 forces spacer 50 against coupling 38. When it is desired to adjust the depth of drive, coupling 38 is manually rotated by engaging knurled outer surface 42 by the finger of the tool operator. Rotation of coupling 38 causes cam surface 46 to be forced away from spacer 50 against the force of springs 62 and 48, and this rotational movement causes lower safety rod **32*b* to be displaced away from the bottom of guide body 22. Alternatively, coupling 38 can be pushed upwardly against the force of spring 64 until cam surfaces 46 and 61 are not touching, and then rotated. When the desired depth of drive has been attained, coupling 38 is placed in a position where camming surfaces 46 and 61 are in mating engagement, so that the force of springs 48 and 62 will cause spacer 50 to retain coupling 38** in place so that it cannot rotate.

Rotation of coupling 38 in clockwise direction will cause lower safety rod **32*b* in one direction, while rotation in the counterclockwise direction will cause lower safety rod 32*b*** in the opposite direction.

While the invention has been shown and described in terms of a preferred embodiment thereof, it will be understood that this invention is not limited to this particular embodiment and that changes and modifications may be made without departing from the true spirit and scope of the invention as defined in the appended claims.

What is claimed is:

1. An adjustable depth control for use with a fastener driving tool having a trigger and a workpiece contacting element shiftable between an unactuated position where the element is not in contact with a workpiece and an actuated position where the element is pressed against the workpiece with sufficient force to allow the tool to operate when the trigger is activated, comprising:

a cylindrical coupling, having an upper section containing an axial bore and a lower section containing a threaded axial bore, said lower section having a bottom cam surface;

an upper rod, containing an annular groove at its lowermost end, which is rigidly affixed within said axial bore in said upper section of said coupling;

a lower rod, having an externally threaded upper portion which is affixed within said threaded axial bore of said lower section of said coupling;

locking means having an upper cam surface for engaging said cam surface of said coupling; a first spring for biasing said coupling against said locking means;

and a second spring for biasing said locking means against said coupling;

whereby when said coupling is shifted toward said first spring and out of engagement with said locking means, said coupling may be rotated to shift said lower rod to a different position relative to said upper rod.

2. The device of claim 1, wherein the outer surface of said lower section of said coupling is knurled.

3. The device of claim 1, wherein said coupling contains a traverse aperture through said upper section.

4. The device of claim 3, further comprising a retainer for attaching said upper rod within said axial bore in said upper section.

5. The device of claim 4, wherein said retainer contains a plurality of lugs which pass through said aperture of said coupling and are held within said groove of said upper rod.

6. The device of claim 1, wherein said locking means is fixed from rotation with respect to said coupling.

7. The device of claim 1, wherein said first spring has a higher spring force rate than said second spring.

8. The device of claim 1, wherein rotational movement of said coupling causes axial movement of said lower rod.

* * * * *